US007004738B2

(12) United States Patent
Becker et al.

(10) Patent No.: US 7,004,738 B2
(45) **Date of Patent: *Feb. 28, 2006**

(54) APPARATUS FOR PRODUCING MELT-BLOWN WEBS

(75) Inventors: Axel Becker, Troisdorf (DE); Hans-Peter Schlag, Troisdorf (DE); Hans-Georg Geus, Niederkassel-Rheidt (DE); Detlef Frey, Niederkassel-Rheidt (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 127 days.

This patent is subject to a terminal disclaimer.

(21) Appl. No.: 10/375,894

(22) Filed: Feb. 27, 2003

(65) Prior Publication Data

US 2004/0009251 A1 Jan. 15, 2004

(30) Foreign Application Priority Data

Feb. 28, 2002 (EP) ..... 02004616

(51) Int. Cl.
*B29D 7/00* (2006.01)

(52) U.S. Cl. ..... 425/72.2; 156/441

(58) Field of Classification Search ..... 425/66, 425/72.2, 382.2, DIG. 17; 264/210.8, 211.14, 264/211.12, 103, DIG. 75; 156/441, 167, 156/166, 180, 181

See application file for complete search history.

(56) References Cited

U.S. PATENT DOCUMENTS 6,499,982 B1 * 12/2002 Allen et al. ..... 425/83.1
2003/0161904 A1 * 8/2003 Geus et al. ..... 425/72.2

* cited by examiner

*Primary Examiner*—Joseph S. Del Sole
(74) *Attorney, Agent, or Firm*—Herbert Dubno

(57) ABSTRACT

An apparatus for producing a melt blown web in which the collecting screen upon which the filaments are deposited passes over a plurality of suction regions or areas which have respective suction blowers and controls for the suction force and air throughput.

5 Claims, 3 Drawing Sheets

APPARATUS FOR PRODUCING MELT-BLOWN WEBS

FIELD OF THE INVENTION

Our present invention relates to an apparatus for the production of melt-blown products using a nozzle discharging a stream of filaments, a continuously moveable deposit screen underneath the nozzle onto which the filaments for the melt-blown product can be deposited and on which the filaments are collected to form a web, and a suction device below the screen for drawing air through the deposit screen.

BACKGROUND OF THE INVENTION

In an apparatus for producing a melt-blown web and/or during the melt-blown process a polymer melt discharged from a nozzle is impinged upon by a blast air flow. This causes the melt to form polymer fibers, which subsequently are deposited on the deposit or collection screen upon which the melt-blown product is formed.

In prior melt-blown arrangements of the type mentioned on the outset and known from practical operation, only a single suction channel and/or suctioning area is provided in the deposit region of the filaments below a screen. This area has a single suction blower. With the arrangements known, frequently melt-blown products are produced that have undesirable irregularities and/or inhomogeneities. In the suction area and/or in the region of the deposit screen of these melt-blown arrangements known, frequently a more or less intense floating of fibers occurs, causing an uncontrolled deposition of the fibers and, thus, irregularities in the melt-blown product. In particular, these irregularities relate to the product thickness, the air permeability, and the ratio of lateral strength to longitudinal strength of the fiber mat produced as well as irregularities in the surface of the melt-blown product. As a result, the product quality of the melt-blown product is lower than desired.

OBJECTS OF THE INVENTION

The principal object of the invention is to provide an improved apparatus for producing a melt-blown web.

More specifically it is an object of the invention to provide an improved melt-blowing arrangement of the type mentioned on the outset, by which melt-blown products can be produced that are characterized by homogeneity and evenness with regard to their characteristics, and, in particular, which are provided with an optimal surface quality as well.

It is another object to enable the production of melt-blown products which have a consistent product thickness and a constant ratio of lateral strength to longitudinal strength; the air permeability should also be as consistent as possible over the melt-blown product.

SUMMARY OF THE INVENTION

These and other objects are achieved with the invention which provides a melt-blown arrangement of the type mentioned on the outset which has in its longitudinal direction, a plurality of suction areas, independent from one another, below the deposit or collection screen, one of these suction areas being a primary suction area allocated to the main or primary deposit region (i.e. directly below the nozzle). The suction speeds blower speeds and/or throughput in the individual suction areas are adjustable independently from one another.

The travel direction and/or transportation direction of the deposit screen is in the longitudinal direction of the deposit screen. Therefore, the several suction areas separated from one another are arranged one behind the other as seen in the travel direction and/or transportation direction of the deposit screen. The term "deposit region" defines the area of the deposit screen onto which the majority of the filaments is deposited and/or onto which all or almost all of the filaments are initially deposited. In each of the suction areas the suction speed can be adjusted separately and independently from the suction speed of the other suction areas. The suction speed defines the speed of the air suctioned through and/or to the deposit screen m/s. The suctioning device and/or the suctioning blowers of the suctioning device are usually arranged below the deposit screen.

According to the invention, the nozzle discharging the filaments is embodied as a melt-blown blowing head. Furthermore, the scope of this invention includes that the nozzle of the melt-blown arrangement is provided with: a multitude of jet holes and/or jet apertures arranged in a row for the discharge of polymer melt. Therefore, only a single row of jet orifices is provided. Furthermore, the melt-blown arrangement according to the invention is preferably provided with a longitudinal nozzle for the outputting temperature-controlled heated blast air, and this blast air impinges upon the polymer melt and/or the exiting filaments.

Preferably, at least three suction areas, separated from one another, are provided behind one another in the longitudinal direction and/or in the travel direction of the deposit screen. Here, one of these suction areas is the primary suction area.

According to a highly preferred embodiment which is of particular importance within the scope of the invention, four suction areas, separated from one another, are provided. Here an initial suction area and a second suction area are provided in front of the primary suction area in relation to the travel direction of the deposit screen. Additionally, a third suction area is provided here behind the primary suction area in the travel direction of the deposit screen. This embodiment with four suction areas that are independent from one another has proven particularly suitable within the scope of the invention.

According to a feature of the invention the suction speed in the primary suction area is higher than the suction speeds in the other suction areas. Therefore, in the embodiment having four suction areas separated from one another, the suction speed in the primary suction area is higher than the suction speeds in the first, second, and third suction area. It is advantageous for the suction speed in the primary suction area to be at least twice the suction speed in each of the other suction areas. Preferably, the suction speed in the primary suction area is at least twice the suction speed in the first suction area and/or in the second suction area. Preferably, the suctioning speed in the primary suction area is furthermore at least twice the suction speed in the third suction area.

According to a preferred embodiment of the invention, each suction area is provided with a suction blower of its own. Therefore, the suction device of the melt-blown arrangement according to this embodiment is provided with several suction blowers. At each suction blower, the suction speed can be separately adjusted for each suction area. Therefore, an independent adjustment of the suction air flow occurs in each suction area. The evacuated volume flows can be adjusted absolutely independently of one another. Here, the adjustment can be performed with the condition that the suction power in the primary suctioning area is twice as high as the suction power in each of the other suctioning areas.

Advantageously, the individual suction areas are separated from one another by means of limiting walls made from sheet metal. Here, preferably vertically oriented sheet metal is used. "Vertically" in this context includes substantially vertical, i.e. slightly inclined to the vertical (±10°), as well.

The invention is based on the discovery that the deposit of a melt-blown product, e.g. as a non-woven web, can be controlled via the melt-blown arrangement according to the invention optimally and reliably. With the embodiment according to the invention an undesired floating of fibers in the area of the deposit screen can be eliminated and/or efficiently reduced. A very homogenous fiber deposit can be achieved and, surprisingly, inhomogeneities in the melt-blown products deposited can be largely minimized. Disturbing sections of higher or lower thickness in the melt-blown product produced are not observed. Additionally, disturbing inhomogeneities regarding the air permeability of the non-woven web or regarding the ratio of lateral strength to longitudinal strength are excluded. Furthermore, the primary suction area can be made shorter with respect to the longitudinal direction and/or the transportation direction of the deposit screen as compared with the suction area provided in known melt-blown arrangements. This results in advantageous energy savings, because the overall volume flow of suctioned air can be reduced. Without the separation in various suction areas according to the invention a single suction area in the deposit region, requiring a high suction speed, had to be used with larger dimensions in the transportation direction of the deposit screen. Therefore, in the melt-blown arrangements known an unnecessarily high volume stream is displaced, which again calls for high energy expenses.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
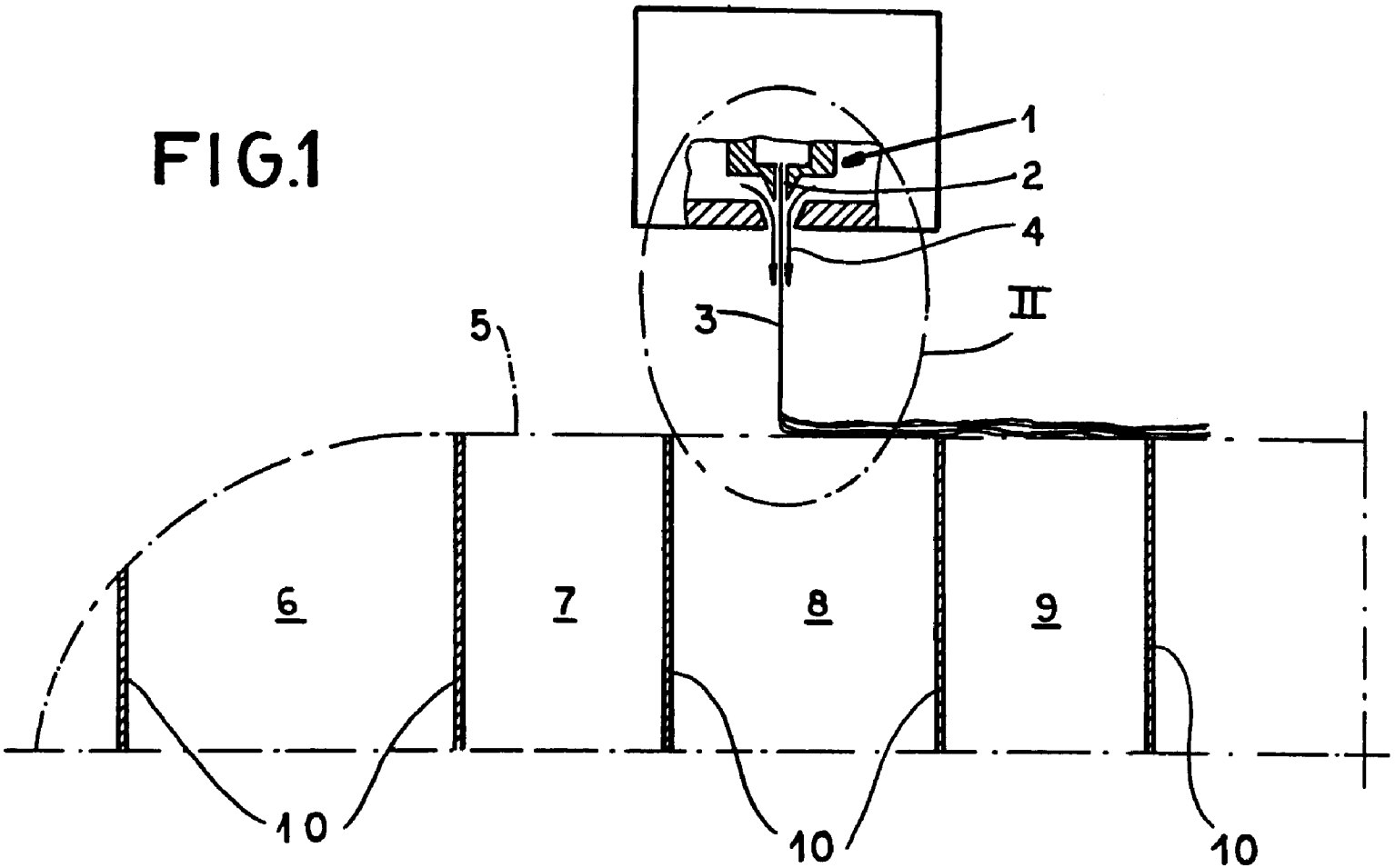
FIG. 1 is a diagrammatic side view, partly broken away, of a melt-blown arrangement according to the invention.

The drawing shows a melt-blown arrangement according to the invention for the production of melt-blown products, namely of non-woven webs. The melt-blown arrangement is provided with a nozzle 1 with the filaments 3 being extruded through its jet apertures 2. Advantageously, the nozzle 1 in the exemplary embodiment is provided with a row comprising a multitude of jet orifices 2. The filaments 3 are impinged upon by heated blast air 4, its direction of flow being shown in the drawing by way of corresponding arrows. Underneath the nozzle a continuously movable deposit screen 5 is provided, onto which the filaments 3 for the melt-blown non-woven web can be deposited. Air is drawn by suction through the deposit screen 5, so that the filaments 3 are more or less fully entrained by suction onto the deposit screen 5.

According to the invention, the deposit screen 5 rides over four suctioning areas or boxes 6, 7, 8, 9, separated from one another by sheet-metal walls and formed from sheet metal walls. One of these suction areas 6, 7, 8, 9 is the primary suction area 8 allocated to the deposit region. The deposit region is defined by that area on the deposit screen 5, on which at least the majority of the filaments 3 are deposited. According to the invention, the suction speed in the suction areas 6, 7, 8, 9 can each be adjusted independently from one another, The suction speed in the primary suction region 8 is higher than the function speeds in the other suction areas 6, 7, 9. Additionally, the suction speed in the second suction area 7 is advantageously higher than the suction speed in the first suction area 6.

According to a preferred embodiment of the invention, each suction area 6, 7, 8, 9 is provided with a suction blower (not shown) of its own. Therefore, the suction speed for the respective suction area 6, 7, 8, 9 can be separately adjusted at each suction blower and allows an independent control and/or adjustment of the suctioned air flow in each suction area 6, 7, 8, 9. Advantageously, in the exemplary embodiment the individual suctioning areas are separated from one another via limiting walls 10 made from sheet metal.

Figure 2:
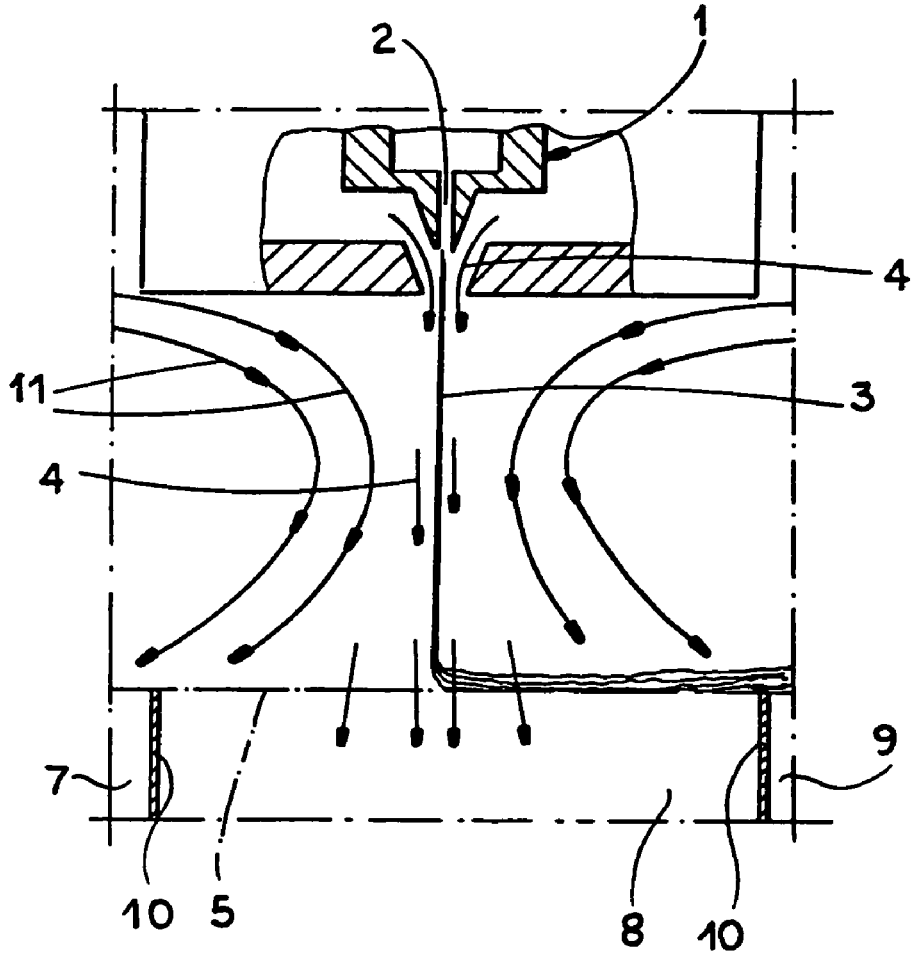
FIG. 2 is an enlarged section of the region II of FIG. 1.

In FIG. 2, in particular, the exiting filaments 3 and the flow direction of the blast air 4 and the flow direction of the suctioned secondary air 11 are discernible, as well. According to the invention, the separation in the individual suction areas 6, 7, 8, 9 and the direction of the blast air 4 as well as the direction of the secondary air 11 can be adjusted such that a very functional and homogenous deposit of the filaments is possible and, thus, surprisingly homogenous product characteristics can be achieved. According to the invention, the third suction area 9, arranged behind the primary suction area 8, serves for the effective contact of the melt-blown product produced to the deposit screen. 5. The invention is based on the knowledge that, without this third suction area 9, the melt-blown product produced might be undesirably influenced by the secondary air suctioned by the blast air exiting with high speeds. The separation into the suction areas 6, 7, 8, 9 according to the invention minimizes disturbing and undesired influences of any air flow.

Figure 3:
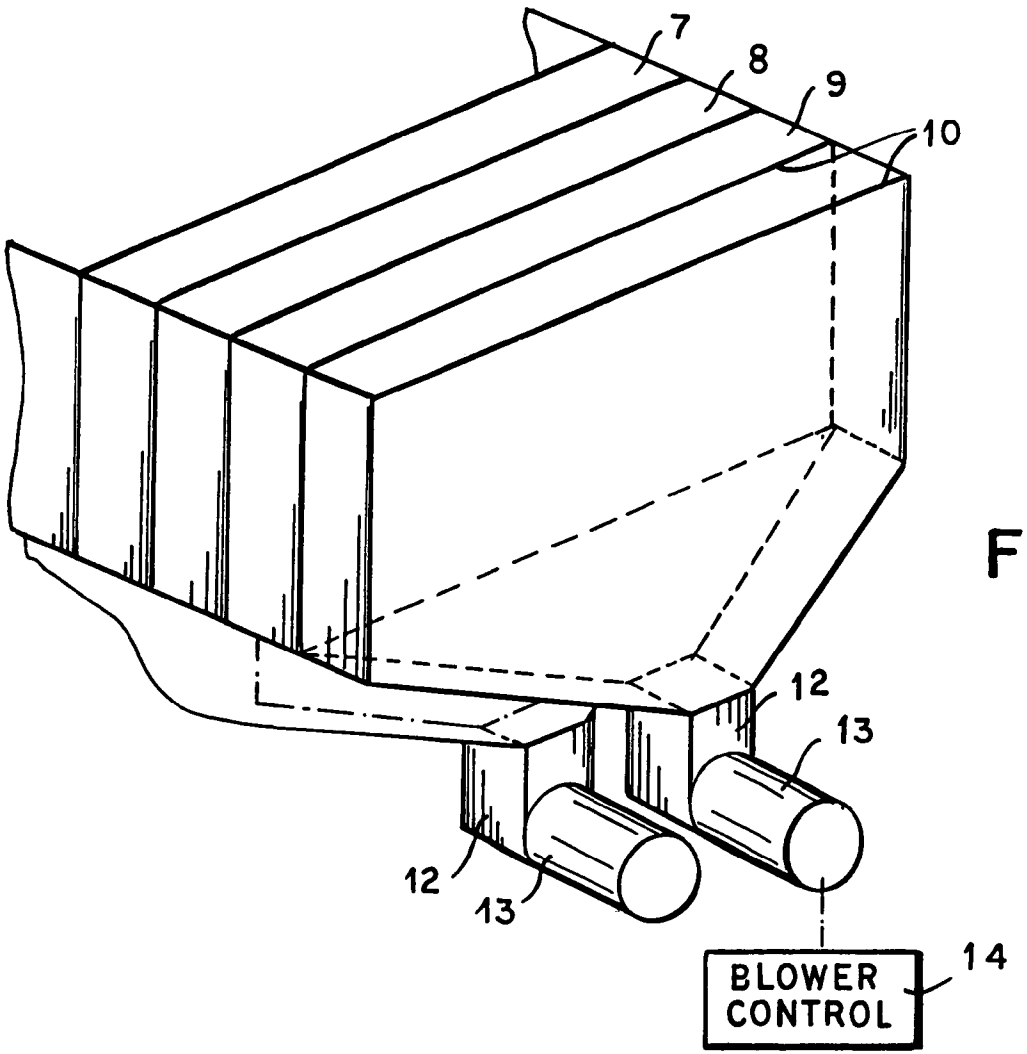
FIG. 3 is a diagrammatic perspective view showing the suction boxes below the screen extending the full width of the melt blown web.

FIG. 3 shows that each of the upwardly open suction boxes 7, 8, 9, etc, forming a suction area has a respective suction blower 12 with its own drive motor 13 and a respective control 14 for individual control of the suction power generated at each suction box.

We claim:

1. An apparatus for producing melt-blown products comprising:

a nozzle for discharging thermoplastic synthetic resin filaments collectable to form a melt-blown product;

a continuously movable deposit screen below said nozzle for collecting said filaments therefrom as said screen is displaced in a longitudinal direction;

a plurality of mutually separated suction areas formed in succession in said direction below said screen for drawing air therethrough to effect deposition of said filaments on said screen, said suction areas being delimited by respective partitions directly separating one suction area from another and reaching upwardly to the screen, said suction areas including a primary suction area directly below said nozzle and drawing a greater quantity of said filaments onto said screen than any other of said suction areas, an initial suction area and a second suction area provided upstream of said primary suction area in said direction, and a third suction area provided downstream of said primary suction area in said direction; and means for adjusting suction speeds in said suction areas independently from one another.

2. The apparatus defined in claim 1 wherein said means for adjusting suction speeds is a respective blower for each of said suction areas, the blower of said primary suction area being set to provide a higher suction speed in the primary suction area than in any of the other suction areas.

3. The apparatus defined in claim 2 wherein said partitions are sheet-metal walls.

4. The apparatus defined in claim 1 wherein each of said suction areas is provided with a respective blower individual thereto.

5. The apparatus defined in claim 1 wherein said partitions are sheet-metal walls.

* * * * *